US011649756B2

(12) United States Patent
Hayama

(10) Patent No.: US 11,649,756 B2
(45) Date of Patent: May 16, 2023

(54) SADDLE-RIDING TYPE VEHICLE EXHAUST STRUCTURE

(71) Applicant: HONDA MOTOR CO., LTD., Tokyo (JP)

(72) Inventor: Yoshitaka Hayama, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/482,475

(22) Filed: Sep. 23, 2021

(65) Prior Publication Data

US 2022/0090533 A1 Mar. 24, 2022

(30) Foreign Application Priority Data

Sep. 24, 2020 (JP) ..... JP2020-159521

(51) Int. Cl.
*F01N 13/08* (2010.01)
*F01N 13/10* (2010.01)

(52) U.S. Cl.
CPC ..... *F01N 13/082* (2013.01); *F01N 13/10* (2013.01); *F01N 2340/04* (2013.01); *F01N 2470/20* (2013.01); *F01N 2590/04* (2013.01)

(58) Field of Classification Search
CPC ..... F01N 2470/20; F01N 2590/04; F01N 2340/04; F01N 13/08
See application file for complete search history.

(56) References Cited

U.S. PATENT DOCUMENTS 11,408,313 B2 * 8/2022 Mahira ..... F01N 1/02
2007/0227810 A1 * 10/2007 Sakurai ..... F01N 1/24 181/251

(Continued)

FOREIGN PATENT DOCUMENTS

JP 01-313610 12/1989
JP 2007-091180 4/2007

(Continued)

OTHER PUBLICATIONS

Japanese Office Action for Japanese Application No. 2020-159521 dated Jun. 28, 2022.

*Primary Examiner* — Anthony Ayala Delgado
(74) *Attorney, Agent, or Firm* — Amin, Turocy & Watson, LLP

(57) ABSTRACT

A saddle-riding type vehicle exhaust structure includes: an exhaust pipe that is connected to an exhaust port connecting to a combustion chamber of an engine and has a circular cross-sectional shape which is orthogonal to an exhaust flow direction; and a muffler that is connected to a downstream side in the exhaust flow direction of the exhaust pipe, wherein the exhaust pipe includes a muffler connection part that is connected to the muffler, an exhaust pipe upstream part that is connected to an upstream side in the exhaust flow direction of the muffler connection part, and an exhaust pipe downstream part that is connected to a downstream side in the exhaust flow direction of the muffler connection part, a cross-sectional area that is orthogonal to the exhaust flow direction of the muffler connection part is larger than each of a minimum value of a cross-sectional area that is orthogonal to an exhaust flow direction of the exhaust pipe upstream part and a minimum value of a cross-sectional area that is orthogonal to an exhaust flow direction of the exhaust pipe downstream part, and a vehicle width direction size of the cross-sectional shape of the muffler connection part and a vertical direction size of the cross-sectional shape of the muffler connection part are different from each other.

5 Claims, 10 Drawing Sheets

(56) References Cited

U.S. PATENT DOCUMENTS

| | | | | |
|---|---|---|---|---|
| 2007/0261907 | A1* | 11/2007 | Nishimura | F01N 13/1811<br>180/296 |
| 2015/0267592 | A1* | 9/2015 | Sakai | F01N 13/08<br>60/323 |
| 2020/0263584 | A1* | 8/2020 | Yagi | B60K 13/04 |

FOREIGN PATENT DOCUMENTS

| | | |
|---|---|---|
| JP | 2015-183516 | 10/2015 |
| JP | 2017-052344 | 3/2017 |
| JP | 6444352 | 12/2018 |
| JP | 2020-026755 | 2/2020 |
| JP | 2020-133489 | 8/2020 |
| WO | 2016/098903 | 6/2016 |

* cited by examiner

SADDLE-RIDING TYPE VEHICLE EXHAUST STRUCTURE

CROSS-REFERENCE TO RELATED APPLICATION

Priority is claimed on Japanese Patent Application No. 2020-159521, filed on Sep. 24, 2020, the contents of which are incorporated herein by reference.

BACKGROUND

Field of the Invention

The present invention relates to a saddle-riding type vehicle exhaust structure.

Background

In the related art, a saddle-riding type vehicle exhaust structure is known which includes an exhaust pipe that is connected to an exhaust port connecting to a combustion chamber of an engine and a muffler that is connected to a downstream side of the exhaust pipe in an exhaust flow direction (for example, refer to Japanese Patent No. 6444352).

SUMMARY

However, there is room for improving a suitable arrangement of the exhaust pipe while improving the output of the engine.

An aspect of the present invention is intended to suitably arrange an exhaust pipe while improving the output of an engine.

A saddle-riding type vehicle exhaust structure according to a first aspect of the present invention includes: an exhaust pipe that is connected to an exhaust port connecting to a combustion chamber of an engine and has a circular cross-sectional shape which is orthogonal to an exhaust flow direction; and a muffler that is connected to a downstream side in the exhaust flow direction of the exhaust pipe, wherein the exhaust pipe includes a muffler connection part that is connected to the muffler, an exhaust pipe upstream part that is positioned on an upstream side in the exhaust flow direction of the muffler connection part, and an exhaust pipe downstream part that is positioned on a downstream side in the exhaust flow direction of the muffler connection part, a cross-sectional area that is orthogonal to the exhaust flow direction of the muffler connection part is larger than each of a minimum value of a cross-sectional area that is orthogonal to an exhaust flow direction of the exhaust pipe upstream part and a minimum value of a cross-sectional area that is orthogonal to an exhaust flow direction of the exhaust pipe downstream part, and a vehicle width direction size of the cross-sectional shape of the muffler connection part and a vertical direction size of the cross-sectional shape of the muffler connection part are different from each other.

A second aspect of the present invention is the saddle-riding type vehicle exhaust structure according to the first aspect described above, wherein the engine may include a crankcase and a cylinder that stands from the crankcase and that has the exhaust port, the exhaust pipe may be connected to the exhaust port, be curved, pass a side of the cylinder, then pass above the crankcase, and extend rearward and upward, and the vehicle width direction size of the cross-sectional shape of the muffler connection part may be smaller than the vertical direction size of the cross-sectional shape of the muffler connection part.

A third aspect of the present invention is the saddle-riding type vehicle exhaust structure according to the first or second aspect described above, wherein the vehicle width direction size of the cross-sectional shape of the muffler connection part may be smaller than a maximum value of the vehicle width direction size of the cross-sectional shape of the exhaust pipe upstream part.

A fourth aspect of the present invention is the saddle-riding type vehicle exhaust structure according to any one of the first to third embodiments described above, wherein the engine may be supported by a vehicle body frame, the vehicle body frame may include a main frame that extends rearward and downward from a head pipe and a pivot plate that extends downward from a rear end part of the main frame, and the muffler connection part may pass an inside in a vehicle width direction of the pivot plate and overlap the pivot plate when seen from a vehicle width direction.

A fifth aspect of the present invention is the saddle-riding type vehicle exhaust structure according to the fourth aspect described above, wherein a swing arm may be swingably supported by the pivot plate, the swing arm and the vehicle body frame may be connected by a rear cushion, and the muffler connection part may be arranged between the pivot plate and the rear cushion in the vehicle width direction.

A sixth aspect of the present invention is the saddle-riding type vehicle exhaust structure according to any one of the first to fifth aspects described above, wherein the engine may be supported by a vehicle body frame, a connection member that connects the vehicle body frame to the exhaust pipe may be provided, and the connection member may be welded to at least a surface of the muffler connection part having a larger one of the vehicle width direction size of the cross-sectional shape and the vertical direction size of the cross-sectional shape.

According to the saddle-riding type vehicle exhaust structure of the first aspect of the present invention, the structure includes: the exhaust pipe that is connected to the exhaust port connecting to the combustion chamber of the engine and has the circular cross-sectional shape which is orthogonal to the exhaust flow direction; and the muffler that is connected to the downstream side in the exhaust flow direction of the exhaust pipe, wherein the exhaust pipe includes the muffler connection part that is connected to the muffler, the exhaust pipe upstream part that is positioned on the upstream side in the exhaust flow direction of the muffler connection part, and the exhaust pipe downstream part that is positioned on the downstream side in the exhaust flow direction of the muffler connection part, the cross-sectional area that is orthogonal to the exhaust flow direction of the muffler connection part is larger than each of the minimum value of the cross-sectional area that is orthogonal to the exhaust flow direction of the exhaust pipe upstream part and the minimum value of the cross-sectional area that is orthogonal to the exhaust flow direction of the exhaust pipe downstream part, and the vehicle width direction size of the cross-sectional shape of the muffler connection part and the vertical direction size of the cross-sectional shape of the muffler connection part are different from each other. Thereby, the following advantage is achieved.

By the cross-sectional area that is orthogonal to the exhaust flow direction of the muffler connection part being larger than each of the minimum value of the cross-sectional area that is orthogonal to the exhaust flow direction of the exhaust pipe upstream part and the minimum value of the cross-sectional area that is orthogonal to the exhaust flow direction of the exhaust pipe downstream part, since it is possible to adjust the pulsation of the exhaust gas in the exhaust pipe and actively suction a combustion gas in the combustion chamber of the engine, it is possible to improve the output of the engine. Additionally, the vehicle width direction size of the cross-sectional shape of the muffler connection part and the vertical direction size of the cross-sectional shape of the muffler connection part are different from each other, and thereby, it is possible to use an arrangement that prevents an increase in size of the vehicle or an arrangement that prevents the effect of interference on another configuration component. Accordingly, it is possible to suitably arrange the exhaust pipe while improving the output of the engine.

According to the saddle-riding type vehicle exhaust structure of the second aspect of the present invention, the engine includes the crankcase and the cylinder that stands from the crankcase and that has the exhaust port, the exhaust pipe is connected to the exhaust port, is curved, passes a side of the cylinder, then passes above the crankcase, and extends rearward and upward, and the vehicle width direction size of the cross-sectional shape of the muffler connection part is smaller than the vertical direction size of the cross-sectional shape of the muffler connection part. Thereby, the following advantage is achieved.

Even in a case where the exhaust pipe passes above the crankcase and extends rearward and upward, since the muffler connection part does not occupy a space in the vehicle width direction, it is possible to prevent an increase in size in the vehicle width direction. Accordingly, it is possible to achieve both output improvement of the engine and prevention of an increase in size in the vehicle width direction.

According to the saddle-riding type vehicle exhaust structure of the third aspect of the present invention, the vehicle width direction size of the cross-sectional shape of the muffler connection part is smaller than the maximum value of the vehicle width direction size of the cross-sectional shape of the exhaust pipe upstream part, and thereby, the following advantage is achieved.

It is possible to further prevent an increase in size in the vehicle width direction.

According to the saddle-riding type vehicle exhaust structure of the fourth aspect of the present invention, the engine is supported by the vehicle body frame, the vehicle body frame includes the main frame that extends rearward and downward from the head pipe and the pivot plate that extends downward from the rear end part of the main frame, and the muffler connection part passes the inside in the vehicle width direction of the pivot plate and overlaps the pivot plate when seen from the vehicle width direction. Thereby, the following advantage is achieved.

Since a foot part of a rider is generally located on the side of the pivot plate, the muffler connection part passes the inside in the vehicle width direction of the pivot plate, and thereby, it is possible to reduce a thermal impact on the foot part of the rider. Additionally, the muffler connection part overlaps the pivot plate when seen from the vehicle width direction, and thereby, it is possible to further prevent an increase in size in the vehicle width direction.

According to the saddle-riding type vehicle exhaust structure of the fifth aspect of the present invention, the swing arm is swingably supported by the pivot plate, the swing arm and the vehicle body frame are connected by the rear cushion, and the muffler connection part is arranged between the pivot plate and the rear cushion in the vehicle width direction. Thereby, the following advantage is achieved.

It is possible to further prevent an increase in size in the vehicle width direction.

According to the saddle-riding type vehicle exhaust structure of the sixth aspect of the present invention, the engine is supported by the vehicle body frame, the connection member that connects the vehicle body frame to the exhaust pipe is provided, and the connection member is welded to at least a surface of the muffler connection part having a larger one of the vehicle width direction size of the cross-sectional shape and the vertical direction size of the cross-sectional shape. Thereby, the following advantage is achieved.

Since a surface having a larger one of the vehicle width direction size of the cross-sectional shape and the vertical direction size of the cross-sectional shape in the muffler connection part has a larger curvature radius than a surface having a smaller one of the vehicle width direction size of the cross-sectional shape and the vertical direction size of the cross-sectional shape in the muffler connection part, in comparison with a case where the connection member is welded to the surface of the muffler connection part having a smaller one of the vehicle width direction size of the cross-sectional shape and the vertical direction size of the cross-sectional shape, welding work is facilitated.

DESCRIPTION OF EMBODIMENTS

Figure 1:
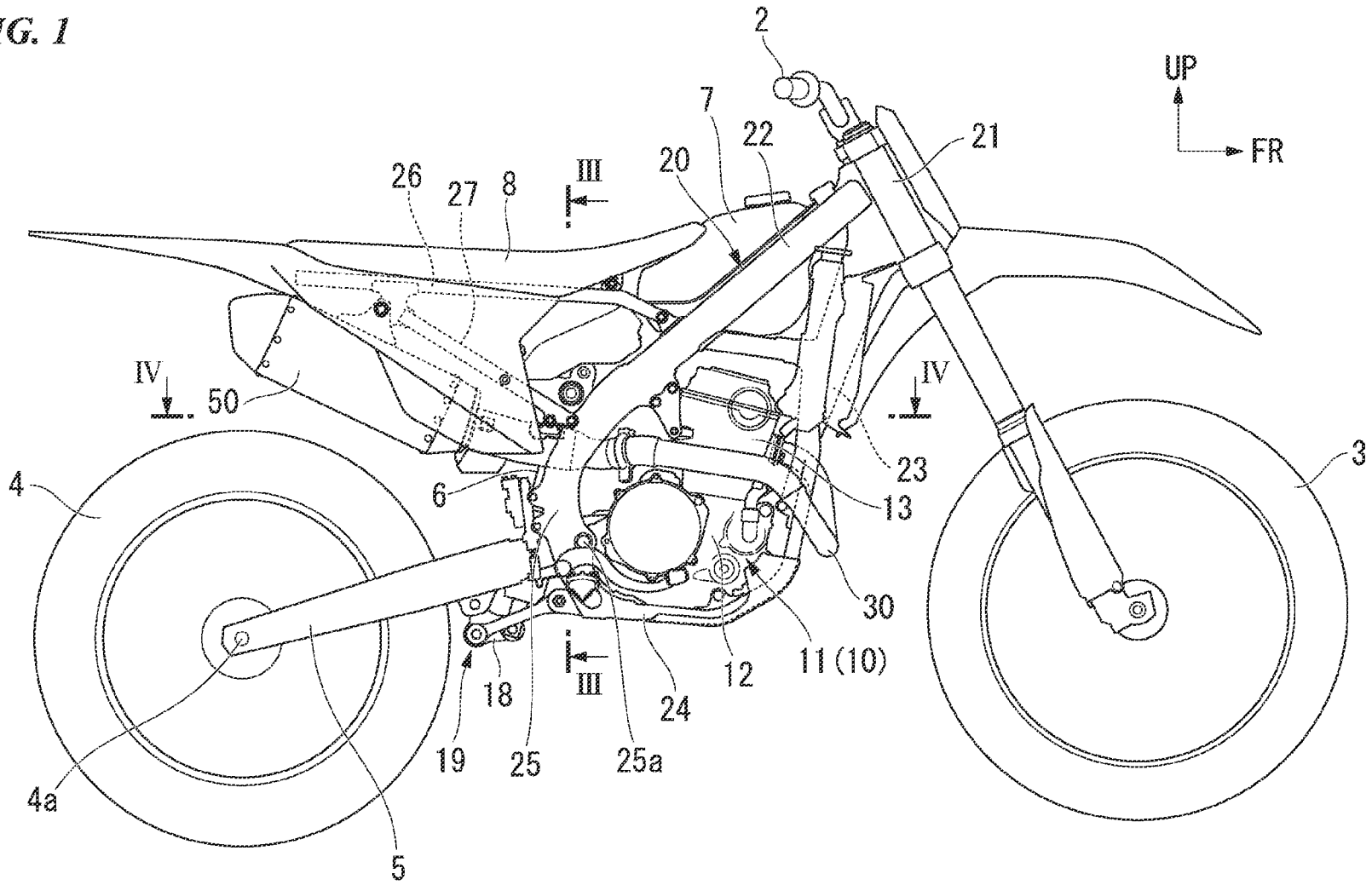
FIG. 1 is a right side view of a motorcycle according to an embodiment.

Hereinafter, an embodiment of the present invention will be described with reference to the drawings. In the following description, a motorcycle as an example of a saddle-riding type vehicle is described. In appropriate places in the drawing used in the following description, an arrow FR that indicates a vehicle frontward direction of the motorcycle of the present embodiment, an arrow LH that indicates a vehicle leftward direction, an arrow UP that indicates a vehicle upward direction, and a line CL that indicates a center in a right-to-left direction of a vehicle body are shown.

<Entire Vehicle>

As shown in FIG. 1, the motorcycle 1 (saddle-riding type vehicle) includes a front wheel 3 that is steered by a handle 2, a rear wheel 4 that is driven by a power unit 10 including a power source, and a vehicle body frame 20 that supports the power unit 10. Hereinafter, the motorcycle is simply referred to as a "vehicle".

The vehicle body frame 20 includes: a head pipe 21 that steerably supports the handle 2; a pair of right and left main frames 22 that extend rearward and downward from the head pipe 21; a down frame 23 that extends rearward and downward from the head pipe 21 more steeply than the main frame 22; a pair of right and left lower frames 24 that extend rearward from a lower end part of the down frame 23; a pair of right and left pivot plates 25 that extend downward from a rear end part of the main frame 22 and are connected to a rear end part of the lower frame 24; a pair of right and left seat rails 26 that extend rearward from a rear end part of the main frame 22; and a pair of right and left rear frames 27 that extend rearward and upward from a middle part in a vertical direction of the pivot plate 25 and are connected to a rear end part of the seat rail 26.

An axle 4*a* of the rear wheel 4 is supported by a rear end part of the swing arm 5 that extends in a front-to-rear direction.

A front end part of the swing arm 5 is supported by a lower part of the pivot plate 25 via a pivot shaft 25*a* to be swingable upward and downward. A link mechanism 19 having a link member 18 is provided between a lower part of the pivot plate 25 and a front end part of the swing arm 5. A rear cushion 6 that extends in the vertical direction is provided between an upper part of the pivot plate 25 and the link member 18.

The power unit 10 includes: an engine 11 which is an internal combustion engine that burns a combustible air-fuel mixture and obtains an output; an ACG (not shown) that functions as a generator; and a transmission (power transmission mechanism, not shown) that is connected to a crankshaft (not shown) and transmits power from the engine 11 to the rear wheel 4 which is a drive wheel. A fuel tank 7 that is supported by the right and left main frames 22 is provided above the engine 11. A seat 8 that is supported by the right and left seat rails 26 is provided at the rear of the fuel tank 7.

<Engine>

The engine 11 includes a crankcase 12 that accommodates a crankshaft (not shown) and a cylinder 13 that stands to be slightly tilted frontward from a front upper part of the crankcase 12 toward an upward direction.

Figure 2:
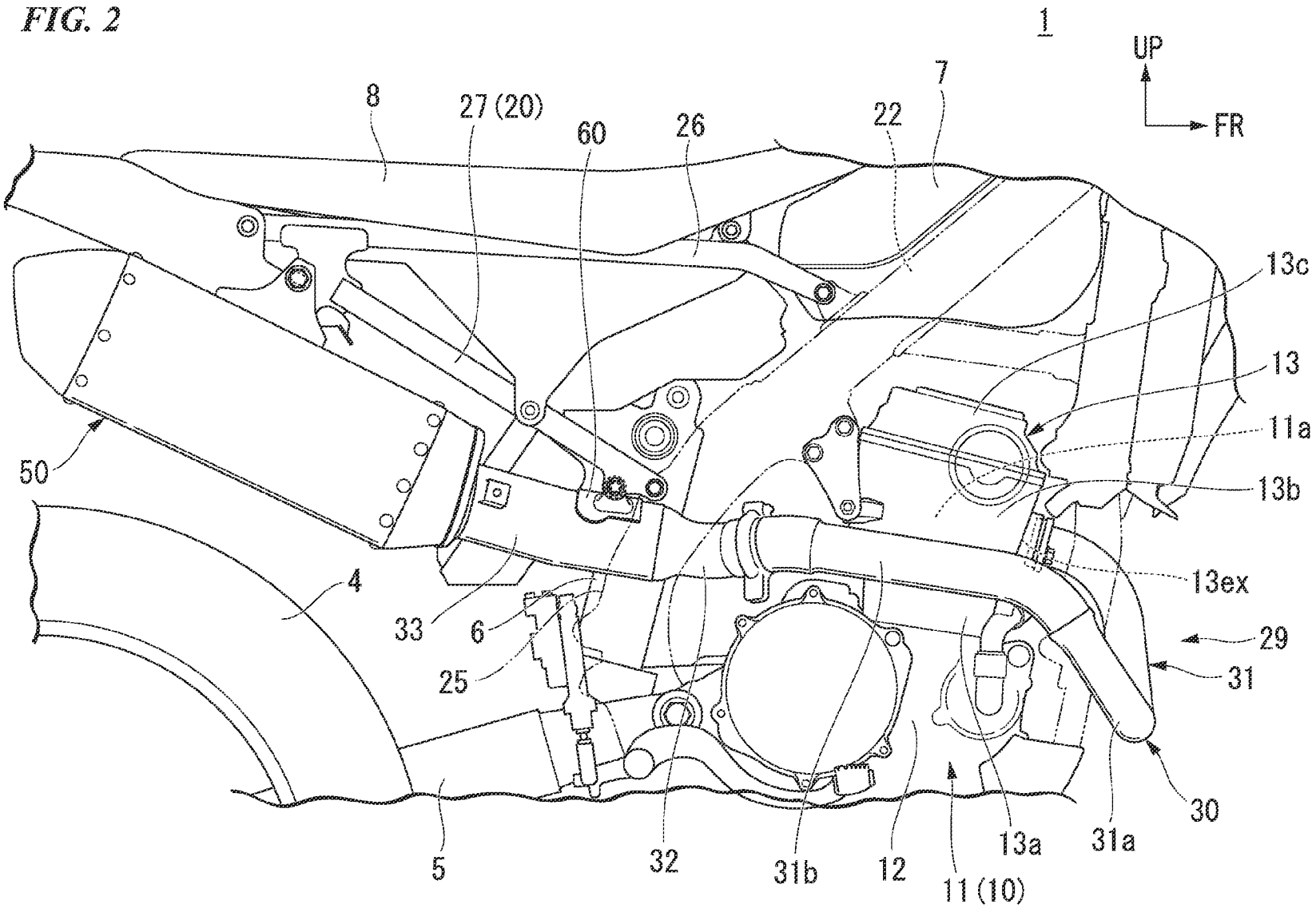
FIG. 2 is a right side view of an exhaust structure of the motorcycle according to the embodiment.

As shown in FIG. 2, the cylinder 13 includes: a cylinder block 13*a* that is connected to the front upper part of the crankcase 12; a cylinder head 13*b* that is connected to an upper part of the cylinder block 13*a*; and a head cover 13*c* that is connected to an upper part of the cylinder head 13*b*. An exhaust port 13*ex* that is connected to a combustion chamber 11*a* of the engine 11 is provided on a front wall of the cylinder head 13*b*.

<Exhaust Structure>

An exhaust structure 29 includes: an exhaust pipe 30 that is connected to the exhaust port 13*ex*; and a muffler 50 that is connected to a downstream side in an exhaust flow direction of the exhaust pipe 30. Here, the exhaust flow direction means a direction in which the exhaust gas from the exhaust port 13*ex* flows. Hereinafter, a cross-sectional shape that is orthogonal to the exhaust flow direction of the exhaust pipe 30 is also simply referred to as a "cross-sectional shape".

<Exhaust Pipe>

The cross-sectional shape of the exhaust pipe 30 is a circular shape. Here, the circular shape includes a true circle shape, an oval shape, and an ellipse shape. The exhaust pipe 30 has a cylindrical shape that extends along the exhaust flow direction while changing the cross-sectional shape. The exhaust pipe 30 is connected to the exhaust port 13*ex*, is curved, passes a right side of the cylinder 13, then passes above the crankcase 12, and extends rearward and upward.

Figure 9:
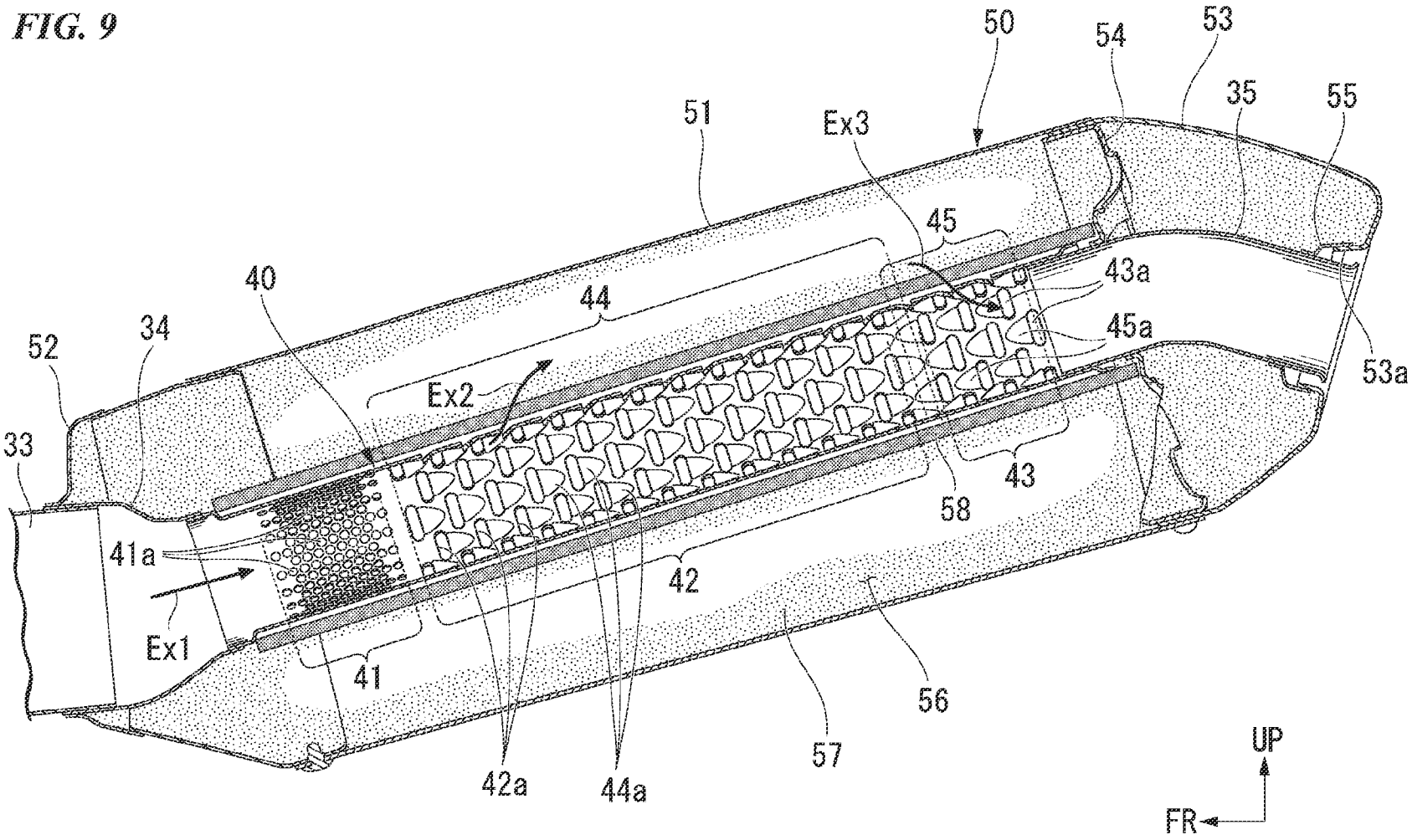
FIG. 9 is a left side view that includes a IX-IX cross section of FIG. 7.

The exhaust pipe 30 includes an exhaust pipe 31, a first front pipe 32, a second front pipe 33 (muffler connection part), a third front pipe 34 (refer to FIG. 6), an inner pipe 40, and a tail pipe 35 (refer to FIG. 9). The first front pipe 32, the second front pipe 33 (muffler connection part), the third front pipe 34 (refer to FIG. 6), the inner pipe 40, and the tail pipe 35 (refer to FIG. 9) are provided in this order in the exhaust flow direction.

In a side view of FIG. 2, the exhaust pipe 31 includes: a first extension part 31*a* that is curved and extends frontward and downward from the exhaust port 13*ex* and then extends rearward and upward; and a second extension part 31*b* that is curved from a downstream end in the exhaust flow direction of the first extension part 31*a*, passes a right side of the cylinder head 13*b* and above the crankcase 12, and extends rearward and upward. In a top view of FIG. 4, the first extension part 31*a* extends frontward from the exhaust port 13*ex* and is then curved and extends rightward.

Figure 4:
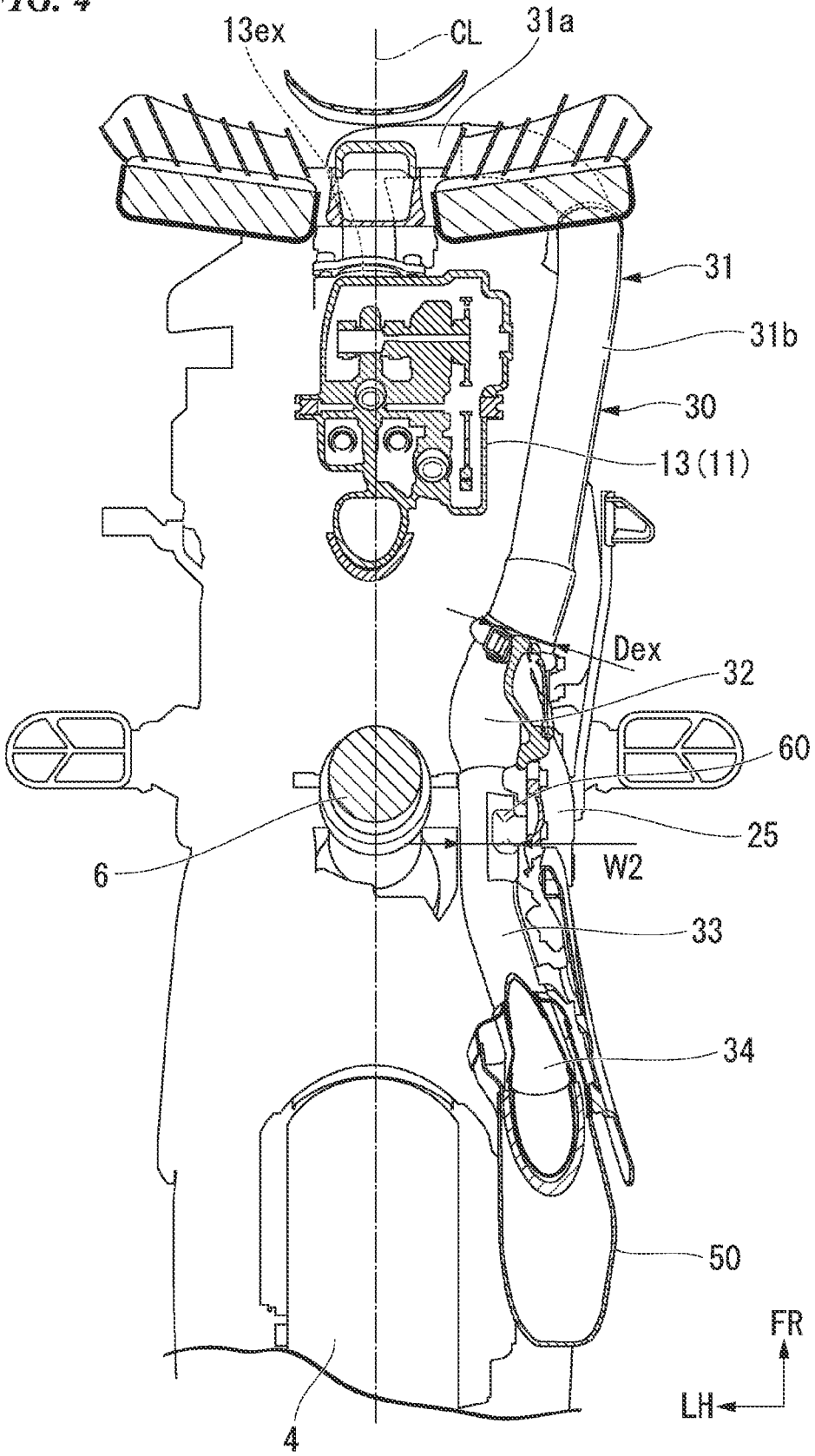
FIG. 4 is a top view that includes a IV-IV cross section of FIG. 1.

In the top view of FIG. 4, the second extension part 31*b* extends to be inclined inward in the vehicle width direction toward the rear from the downstream end in the exhaust flow direction of the first extension part 31*a*.

In the side view of FIG. 2, the first front pipe 32 extends rearward toward the inside in the vehicle width direction of the right pivot plate 25 from the downstream end in the exhaust flow direction of the second extension part 31*b* of the exhaust pipe 31. In a side view of FIG. 5, a rear end part of the first front pipe 32 defines a funnel shape that is enlarged rearward. In the top view of FIG. 4, the first front pipe 32 extends to be inclined inward in the vehicle width direction toward the rear from the downstream end in the exhaust flow direction of the second extension part 31*b*. In a top view of FIG. 7, the rear end part of the first front pipe 32 defines a funnel shape that is enlarged frontward. In other words, the rear end part of the first front pipe 32 defines a funnel shape that narrows toward the downstream side in the exhaust flow direction.

In the side view of FIG. 2, the second front pipe 33 extends rearward and upward from the downstream end in the exhaust flow direction of the first front pipe 32. The cross-sectional area orthogonal to the exhaust flow direction of the second front pipe 33 is a uniform size throughout to the downstream end from an upstream end in the exhaust flow direction of the second front pipe 33 (the entire extension direction). The cross-sectional shape of the second front pipe 33 has a uniform size throughout to the downstream end from the upstream end in the exhaust flow direction of the second front pipe 33. In the top view of FIG. 4, the second front pipe 33 extends rearward from the downstream end in the exhaust flow direction of the first front pipe 32 and then extends to be inclined outward in the vehicle width direction toward the rear.

Figure 3:
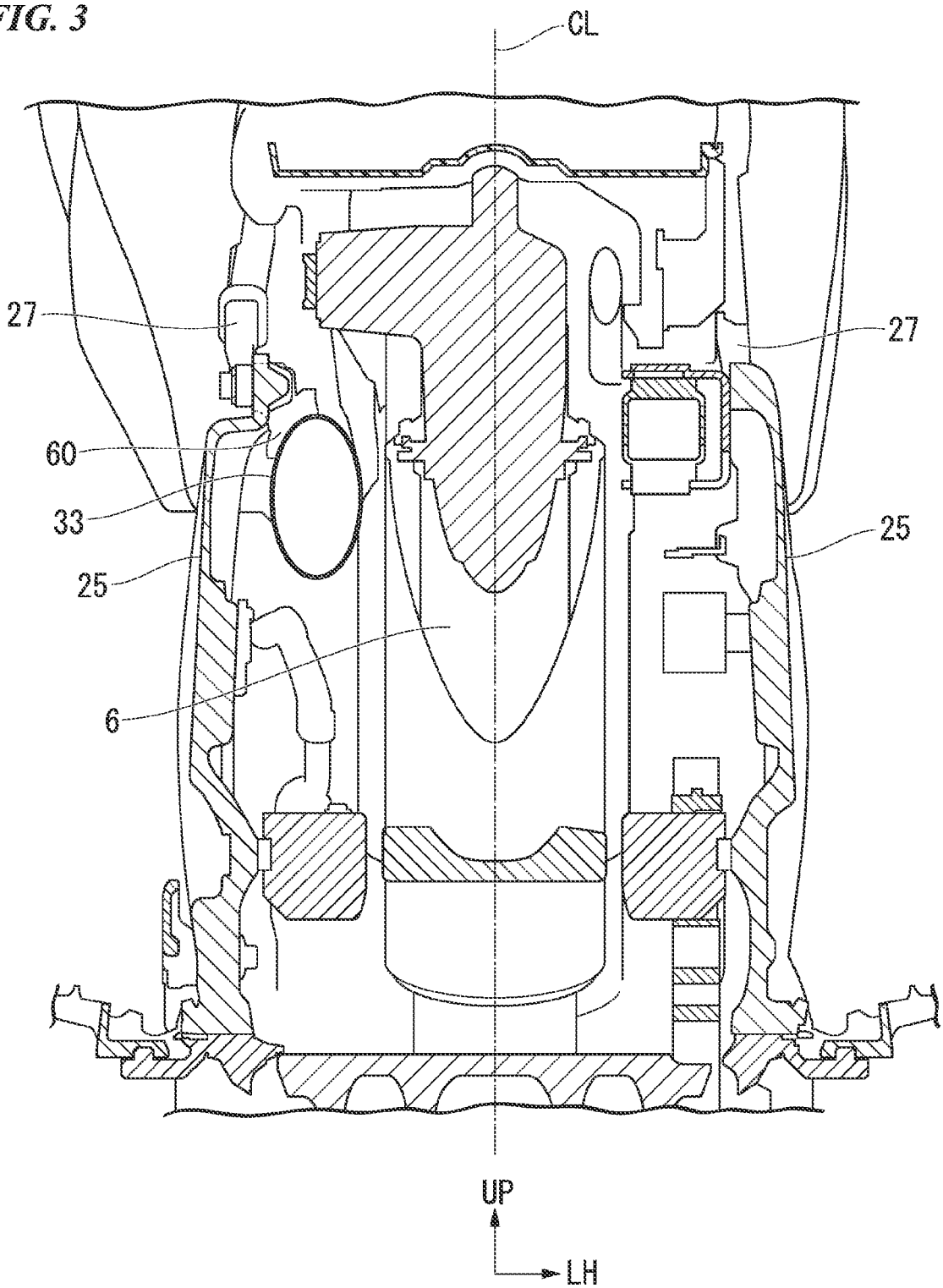
FIG. 3 is a front view that includes a cross section of FIG. 1.

As shown in FIG. 3, the second front pipe 33 passes the inside in the vehicle width direction of the right pivot plate 25. In the side view of FIG. 2, a portion of the second front pipe 33 that passes the inside in the vehicle width direction of the right pivot plate 25 overlaps the right pivot plate 25. As shown in FIG. 3, the second front pipe 33 is arranged between the right pivot plate 25 and the rear cushion 6 in the vehicle width direction.

Figure 6:
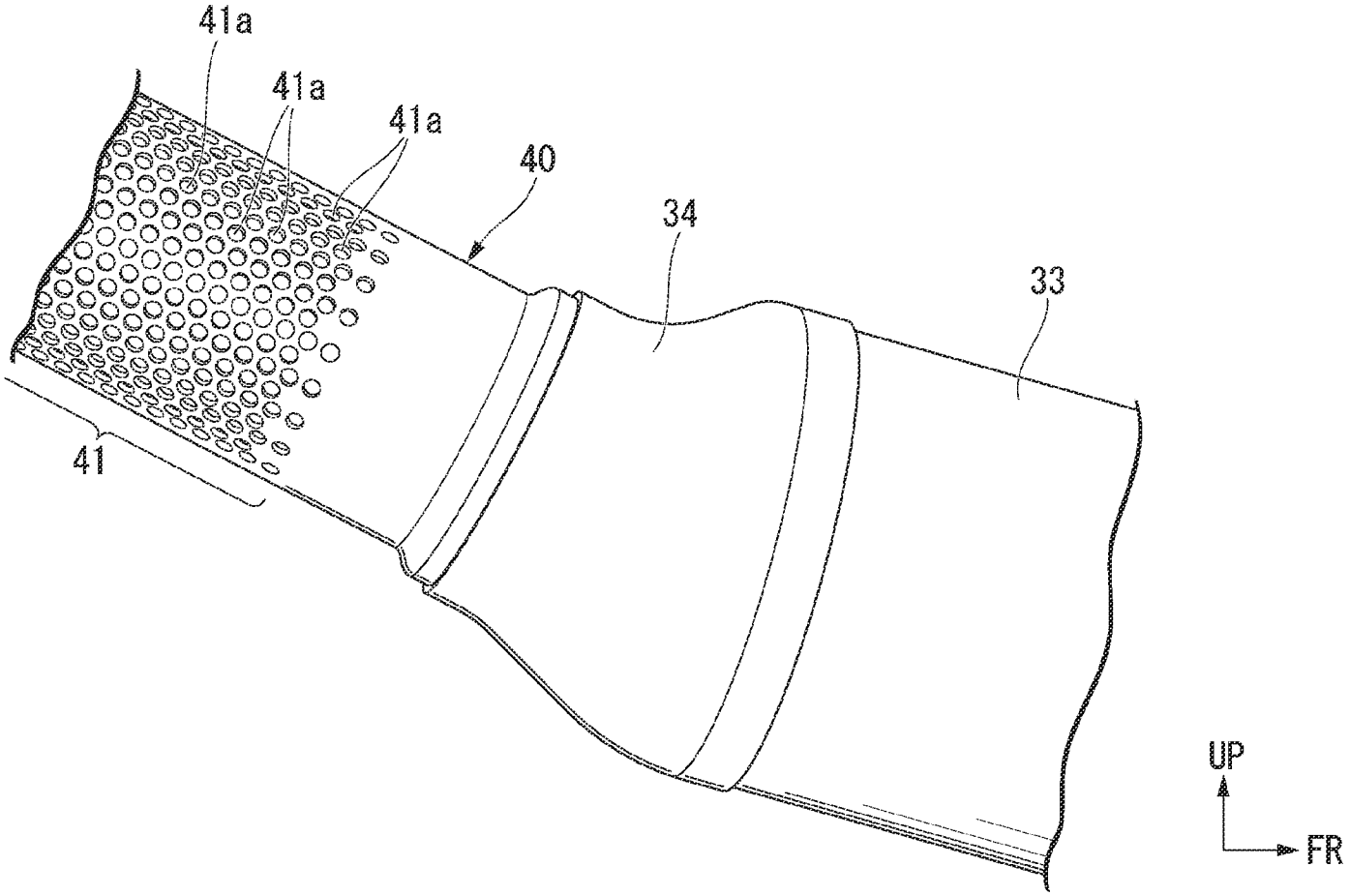
FIG. 6 is an enlarged view of a VI part of FIG. 5 and is a right side view of the second front pipe, a third front pipe, and an inner pipe according to the embodiment.

In a side view of FIG. 6, the third front pipe 34 extends rearward and upward from the downstream end in the exhaust flow direction of the second front pipe 33. The cross-sectional area orthogonal to the exhaust flow direction of the third front pipe 34 is gradually decreased toward the downstream end from the upstream end in the exhaust flow direction of the third front pipe 34. In the side view of FIG. 6, the third front pipe 34 defines a funnel shape that is enlarged toward the front lower direction. As shown in FIG. 9, for example, an outer circumference of a front end part of the third front pipe 34 is welded to an inner circumference of a front end part of a front cap 52 of the muffler 50 in a fitted state.

In the side view of FIG. 6, the inner pipe 40 extends rearward and upward from the downstream end in the exhaust flow direction of the third front pipe 34. As shown in FIG. 9, the inner pipe 40 is arranged within the muffler 50. The inner pipe 40 includes a first punching part 41, a second punching part 42, a third punching part 43, a forward-direction cut-standing part 44, and a reverse-direction cut-standing part 45.

The first punching part 41 is provided on a front part of the inner pipe 40. The first punching part 41 includes a plurality of first punching holes 41*a*. The first punching hole 41*a* has a circular shape when seen from a radial direction of the inner pipe 40. In an example of FIG. 9, the first punching part 41 has a configuration in which nine first punching holes 41*a* that are aligned in an axis direction of the inner pipe 40 are provided in a plurality of rows in the circumferential direction of the inner pipe 40. A plurality of rows of the first punching holes 41*a* are alternately offset back and forth along the axis direction of the inner pipe 40 in the circumferential direction of the inner pipe 40.

The second punching part 42 is provided on a part of the inner pipe 40 at a further rearward side than the first punching part 41. The second punching part 42 includes a plurality of second punching holes 42*a*. The second punching hole 42*a* has an elongated hole shape that extends in the circumferential direction when seen from the radial direction of the inner pipe 40. The plurality of second punching holes 42*a* are arranged in a staggered configuration. In the example of FIG. 9, the second punching part 42 has a configuration in which twelve second punching holes 42*a* that are aligned in the axis direction of the inner pipe 40 and thirteen second punching holes 42*a* that are aligned in the axis direction of the inner pipe 40 are alternately provided in the circumferential direction of the inner pipe 40.

The third punching part 43 is provided on a rear part of the inner pipe 40. The third punching part 43 is provided on a part of the inner pipe 40 at a further rearward side than the second punching part 42. The third punching part 43 includes a plurality of third punching holes 43*a*. The third punching hole 43*a* has an elongated hole shape that extends in the circumferential direction when seen from the radial direction of the inner pipe 40. The plurality of third punching holes 43*a* are arranged in a staggered configuration. In the example of FIG. 9, the third punching part 43 has a configuration in which three third punching holes 43*a* that are aligned in the axis direction of the inner pipe 40 are provided in a plurality of rows in the circumferential direction of the inner pipe 40. A plurality of rows of the third punching holes 43*a* are alternately offset back and forth along the axis direction of the inner pipe 40 in the circumferential direction of the inner pipe 40.

The forward-direction cut-standing part 44 is provided on a part of the inner pipe 40 at a further rearward side than the first punching part 41. The forward-direction cut-standing part 44 is provided at a portion corresponding to the second punching part 42. The forward-direction cut-standing part 44 has a plurality of forward direction standing pieces 44*a* that stand outward in the radial direction of the inner pipe 40 toward the rear side along the axis direction of the inner pipe 40. The forward direction standing piece 44*a* has a triangular shape that protrudes rearward from a rear end of the second punching hole 42*a* along the axis direction of the inner pipe 40 when seen from the radial direction of the inner pipe 40.

The reverse-direction cut-standing part 45 is provided on a rear part of the inner pipe 40. The third punching part 43 is provided on a part of the inner pipe 40 at a further rearward side than the forward-direction cut-standing part 44. The reverse-direction cut-standing part 45 is provided at a portion corresponding to the third punching part 43. The reverse-direction cut-standing part 45 has a plurality of reverse direction standing pieces 45*a* that stand outward in the radial direction of the inner pipe 40 toward the front side along the axis direction of the inner pipe 40. The reverse direction standing piece 45*a* has a triangular shape that protrudes frontward from a front end of the third punching hole 43*a* along the axis direction of the inner pipe 40 when seen from the radial direction of the inner pipe 40. That is, the reverse direction standing piece 45*a* has a triangular shape facing a direction opposite to the forward direction standing piece 44*a* when seen from the radial direction of the inner pipe 40.

In a side view of FIG. 9, the tail pipe 35 extends rearward and upward from a rear end of the inner pipe 40, is then curved, and extends rearward and downward. For example, an outer circumference of a front end part of the tail pipe 35 is welded to an inner circumference of a rear end part of the inner pipe 40 in a fitted state.

<Muffler>

The muffler 50 includes a cylinder body 51, a front cap 52, a rear cap 53, an inner cap 54, and a tail cap 55.

In the side view of FIG. 9, the cylinder body 51 defines a cylindrical shape that extends straight rearward and upward. An expansion room 56 is provided between the cylinder body 51 and the inner pipe 40.

For example, sound-absorption heat-insulation materials 57 and 58 are provided in the expansion room 56. In the example of FIG. 9, a plurality of sound-absorption heat-insulation materials 57 and 58 are provided in the expansion room 56. For example, the plurality of sound-absorption heat-insulation materials 57 and 58 includes a first sound-absorption heat-insulation material 57 such as glass wool and a second sound-absorption heat-insulation material 58 such as metal wool for scattering prevention of the glass wool. The second sound-absorption heat-insulation material 58 is provided between the first sound-absorption heat-insulation material 57 and the inner pipe 40.

In the side view of FIG. 9, the front cap 52 defines a funnel shape that is enlarged rearward.

For example, an outer circumference of a rear end part of the front cap 52 is welded to an inner circumference of a front end part of the cylinder body 51 in a fitted state.

In the side view of FIG. 9, the rear cap 53 defines a funnel shape that is enlarged frontward. For example, an outer circumference of a front end part of the rear cap 53 is welded to an inner circumference of a rear end part of the cylinder body 51 in a fitted state. A rear part of the rear cap 53 has a cylindrical standing part 53*a* having a cylindrical shape that stands frontward and upward.

The inner cap 54 defines an annular shape having a flange on an outer circumference of the inner cap 54. For example, the flange of the inner cap 54 is welded to an inner circumference of a front end part of the rear cap 53 in a fitted state. For example, a front part of the tail pipe 35 is welded to an inner circumference of the inner cap 54 in a fitted state.

In the side view of FIG. 9, the tail cap 55 defines a funnel shape that is enlarged rearward. For example, a rear part of the tail pipe 35 is welded to an inner circumference of a front end part of the tail cap 55 in a fitted state. For example, the cylindrical standing part 53*a* of the rear cap 53 is welded to an inner circumference of a rear end part of the tail cap 55 in a fitted state.

<Action of Inner Pipe>

As shown in FIG. 9, the inner pipe 40 includes the first punching part 41, the second punching part 42, and the third punching part 43 that are provided in this order from the third front pipe 34 to the tail pipe 35, and the forward-direction cut-standing part 44 and the reverse-direction cut-standing part 45 that are provided to correspond to the second punching part 42 and the third punching part 43, respectively.

For example, the exhaust gas via the third front pipe 34 is guided to the inside of the inner pipe 40 (refer to an arrow Ex1 in FIG. 9). Then, the exhaust gas is subject to the influence of friction (pipe wall friction) by a wall surface of the first punching part 41 (the plurality of first punching holes 41*a*). Accordingly, the flow rate of the exhaust gas is decreased due to the influence of the pipe wall friction.

Then, the exhaust gas passes through the second punching part 42 (the plurality of second punching holes 42*a*), flows along the forward-direction cut-standing part 44 (the plurality of forward direction standing pieces 44*a*), and is guided to the expansion room 56 (refer to an arrow Ex2 in FIG. 9).

Then, the exhaust gas flows along the reverse-direction cut-standing part 45 (the plurality of reverse direction standing pieces 45*a*), passes through the third punching part 43 (the plurality of third punching holes 43*a*), and is guided to the inside of the inner pipe 40 (refer to an arrow Ex3 in FIG. 9).

In this way, according to the configuration in which the inner pipe 40 includes the first punching part 41, the second punching part 42, and the third punching part 43 in this order from the third front pipe 34 to the tail pipe 35, and the forward-direction cut-standing part 44 and the reverse-direction cut-standing part 45 corresponding to the second punching part 42 and the third punching part 43, respectively, it is possible to smoothly guide the exhaust gas to the inside of the inner pipe 40 without disturbing the flow of the exhaust gas that flows to the inside of the inner pipe 40. Therefore, it is possible to decrease a pressure loss while ensuring the same sound-absorbing performance as, for example, a configuration (a configuration in which an inner pipe has a forward-direction cut-standing part and a punching part in this order from the third front pipe 34 to the tail pipe 35) that does not have a reverse-direction cut-standing part. Accordingly, it is possible to further improve the output of the engine 11.

<Second Front Pipe>

Figure 5:
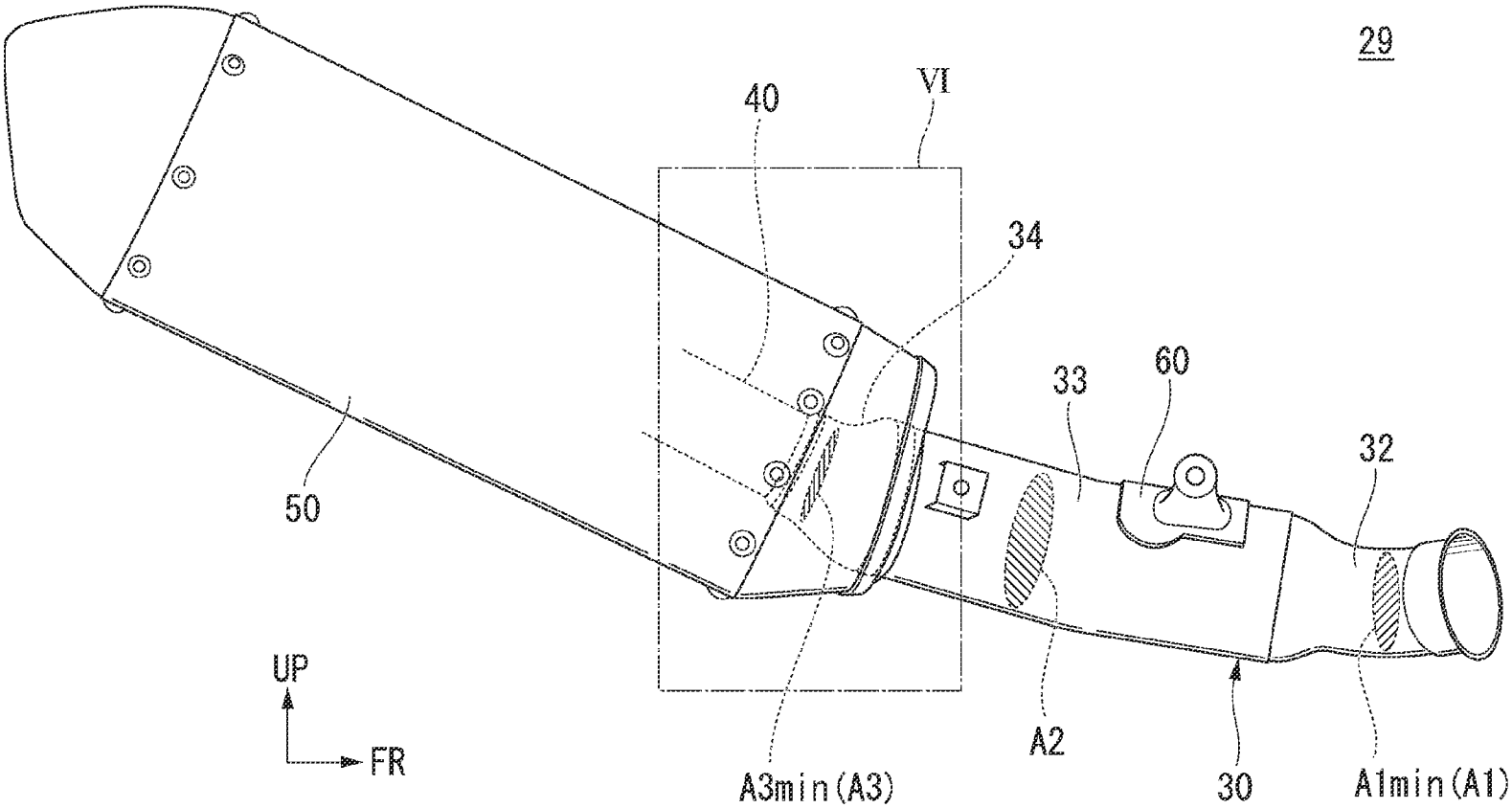
FIG. 5 is a right side view of a first front pipe, a second front pipe, and a muffler according to the embodiment.

As shown in FIG. 5, the first front pipe 32 (exhaust pipe upstream part) is connected to the upstream end in the exhaust flow direction of the second front pipe 33. For example, an outer circumference of a rear end part of the first front pipe 32 is welded to an inner circumference of a front end part of the second front pipe 33 in a fitted state.

As shown in FIG. 9, the third front pipe 34 (exhaust pipe downstream part) is connected to the downstream end in the exhaust flow direction of the second front pipe 33. For example, an outer circumference of a rear end part of the second front pipe 33 is welded to an inner circumference of a front end part of the third front pipe 34 in a fitted state. A rear end part of the second front pipe 33 is connected to a front end part of the front cap 52 of the muffler 50 via the front end part of the third front pipe 34. The second front pipe 33 also functions as a muffler connection part that is connected to the muffler 50.

Hereinafter, a cross-sectional area orthogonal to the exhaust flow direction of the first front pipe 32 is defined as a "first flow path cross-sectional area A1", a cross-sectional area orthogonal to the exhaust flow direction of the second front pipe 33 is defined as a "second flow path cross-sectional area A2", and a cross-sectional area orthogonal to the exhaust flow direction of the third front pipe 34 is defined as a "third flow path cross-sectional area A3".

As shown in FIG. 5, the second flow path cross-sectional area A2 is larger than each of a minimum value A1min of the first flow path cross-sectional area A1 and a minimum value A3min of the third flow path cross-sectional area A3 (A2>A1min, A2>A3min). Here, the minimum value A1min of the first flow path cross-sectional area A1 means a first flow path cross-sectional area A1 of a portion of the first front pipe 32 having the most reduced diameter. The minimum value A3min of the third flow path cross-sectional area A3 means a third flow path cross-sectional area A3 of a portion of the third front pipe 34 having the most reduced diameter.

Figure 8:
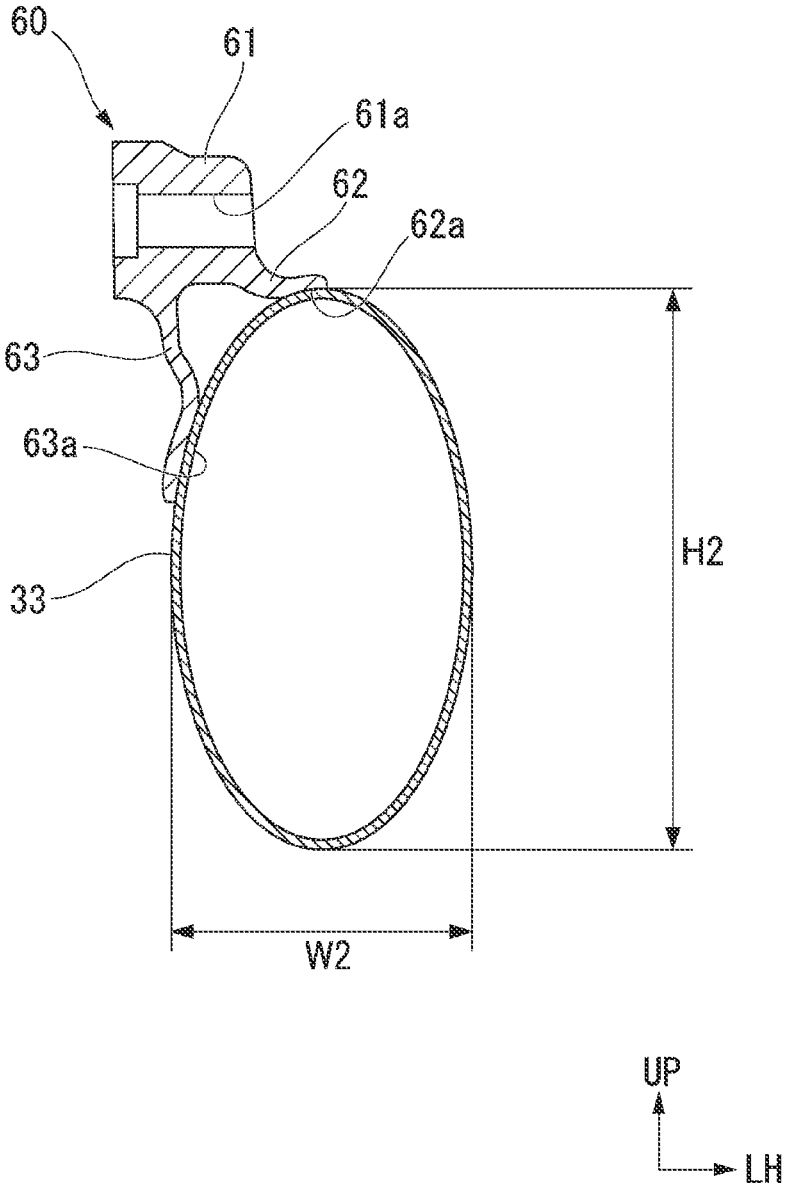
FIG. 8 is a VIII-VIII cross-sectional view of FIG. 7.

As shown in FIG. 8, a vehicle width direction size W2 of the cross-sectional shape of the second front pipe 33 and a vertical direction size H2 of the cross-sectional shape of the second front pipe 33 are different from each other. In the present embodiment, the vehicle width direction size W2 of the cross-sectional shape of the second front pipe 33 is smaller than the vertical direction size H2 of the second front pipe 33 (W2<H2). For example, a ratio H2/W2 of the vertical direction size H2 of the second front pipe 33 to the vehicle width direction size W2 of the cross-sectional shape of the second front pipe 33 can be preferably equal to or more than 1.1 and equal to or less than 5.0 and can be further preferably equal to or more than 1.5 and equal to or less than 2.5.

Figure 7:
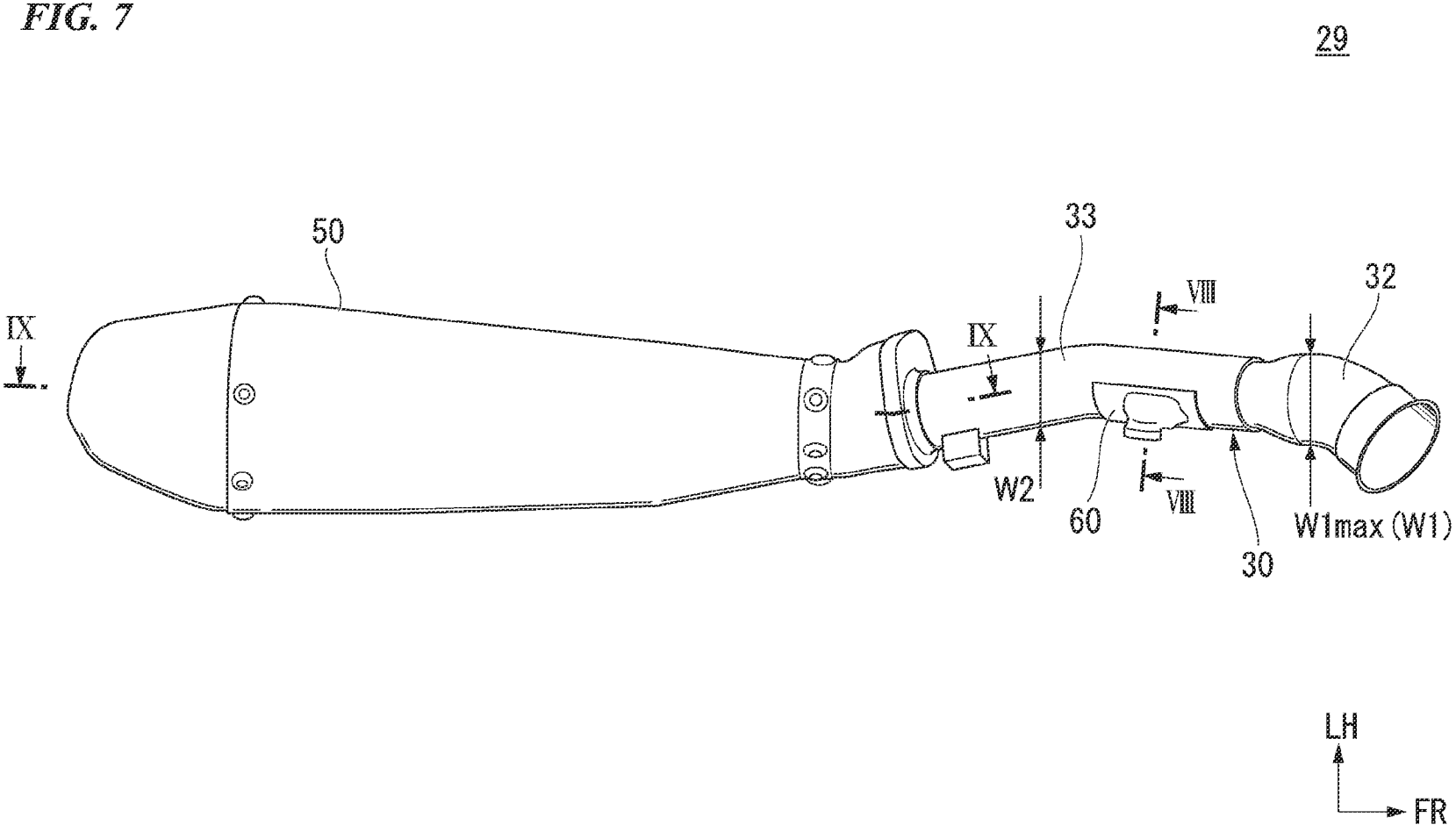
FIG. 7 is a top view of the first front pipe, the second front pipe, and the muffler according to the embodiment.

As shown in FIG. 7, the vehicle width direction size W2 of the cross-sectional shape of the second front pipe 33 is less than a maximum value W1max of the vehicle width direction size W1 of the cross-sectional shape of the first front pipe 32 (W2<W1max). Here, the maximum value W1max of the vehicle width direction size W1 of the cross-sectional shape of the first front pipe 32 means a vehicle width direction size of a portion of the first front pipe 32 having the most enlarged diameter in a top view.

As shown in FIG. 4, the vehicle width direction size W2 of the cross-sectional shape of the second front pipe 33 is smaller than a diameter Dex of a rear end of the exhaust pipe 31 (W2<Dex). Here, the diameter Dex of the rear end of the exhaust pipe 31 means an outer diameter of the downstream end in the exhaust flow direction of the second extension part 31*b*.

<Connection Member>

As shown in FIG. 2, the exhaust pipe 30 is supported by the right rear frame 27 of the vehicle body frame 20 via a connection member 60. For example, the connection member 60 is fixed to the right rear frame 27 via a fastening member such as a bolt. The connection member 60 is welded to at least a surface of the second front pipe 33 having a larger one of the vehicle width direction size W2 of the cross-sectional shape and the vertical direction size H2 of the cross-sectional shape (refer to FIG. 8).

As shown in FIG. 8, the connection member 60 includes: a stay main body 61 having a penetration hole 61*a* through which a bolt is inserted; a first extension part 62 that extends toward an upper surface of the second front pipe 33 from an inner end in the vehicle width direction of a lower part of the stay main body 61; and a second extension part 63 that extends toward a right side surface of the second front pipe 33 from an outer portion in the vehicle width direction of a lower part of the stay main body 61.

The penetration hole 61*a* penetrates through the stay main body 61 in the vehicle width direction. The first extension part 62 has a first curved surface 62*a* having an arc shape along a right upper end part of an upper surface of the second front pipe 33. The second extension part 63 has a second curved surface 63*a* having an arc shape along an upper middle part of a right side surface of the second front pipe 33. The curvature radius of the second curved surface 63*a* is larger than the curvature radius of the first curved surface 62*a*.

The length of the second curved surface 63*a* along the outer circumference of the second front pipe 33 is larger than the length of the first curved surface 62*a* along the outer circumference of the second front pipe 33.

The connection member 60 is welded to a side surface (a surface having a larger one of the vehicle width direction size W2 of the cross-sectional shape and the vertical direction size H2 of the cross-sectional shape) of the second front pipe 33 by each of the first extension part 62 and the second extension part 63. Specifically, the connection member 60 is welded to the right upper end part of the upper surface of the second front pipe 33 by the first curved surface 62*a* and is welded to the upper middle part of the right side surface of the second front pipe 33 by the second curved surface 63*a*.

<Relationship Between Engine Rotation Speed and Output>

Figure 10:
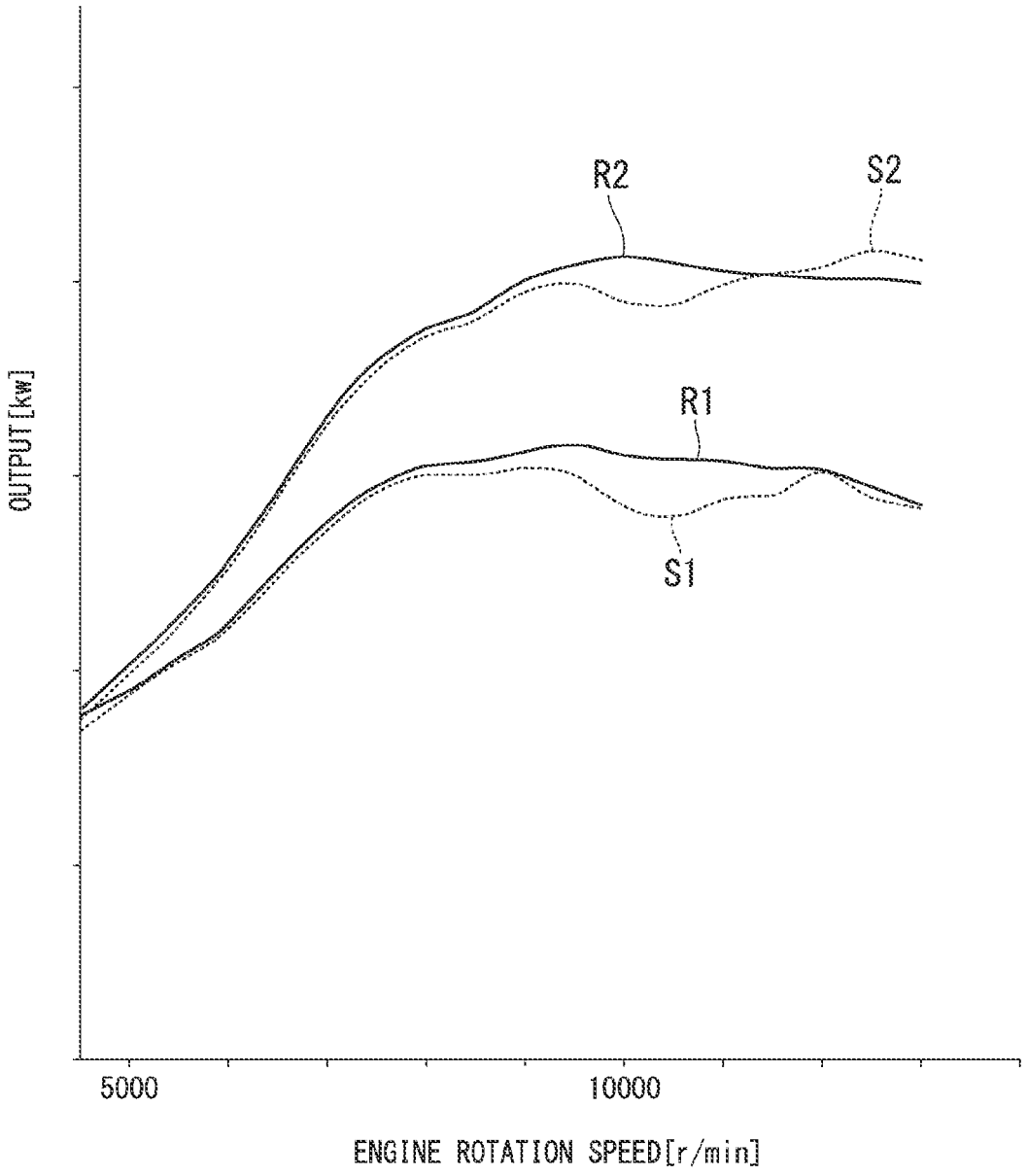
FIG. 10 is a view showing a simulation result of the exhaust structure of the embodiment together with a simulation result of an exhaust structure of a comparison example and is a view showing a relationship between an engine rotation speed and an output.

FIG. 10 is a view showing a simulation result of the exhaust structure of the embodiment together with a simulation result of an exhaust structure of a comparison example and is a view showing a relationship between an engine rotation speed and an output.

In FIG. 10, the horizontal axis represents an engine rotation speed, and the vertical axis represents an output (output of the engine). In FIG. 10, reference numeral R1 represents a graph showing output characteristics of a throttle opening degree of 37.5% of the embodiment, reference numeral R2 represents a graph showing output characteristics of a throttle opening degree of 50% of the embodiment, reference numeral S1 represents a graph showing output characteristics of a throttle opening degree of 37.5% of the comparison example, and reference numeral S2 represents a graph showing output characteristics of a throttle opening degree of 50% of the comparison example.

The exhaust structure of the embodiment corresponds to the exhaust structure 29 described above. That is, as shown in FIG. 2, the exhaust structure of the embodiment includes: the exhaust pipe 30 that is connected to the exhaust port 13*ex* connecting to the combustion chamber 11*a* of the engine 11 and has a circular cross-sectional shape which is orthogonal to the exhaust flow direction; and the muffler 50 that is connected to the downstream side in the exhaust flow direction of the exhaust pipe 30, wherein: the exhaust pipe 30 is connected to the exhaust port 13*ex*, is curved, passes the right side of the cylinder 13, then passes above the crankcase 12, and extends rearward and upward; as shown in FIG. 5, the exhaust pipe 30 includes the second front pipe 33 that is connected to the muffler 50, the first front pipe 32 that is connected to the upstream side in the exhaust flow direction of the second front pipe 33, and the third front pipe 34 that is connected to the downstream side in the exhaust flow direction of the second front pipe 33; the cross-sectional area A2 that is orthogonal to the exhaust flow direction of the second front pipe 33 is larger than the minimum value A1min of the cross-sectional area that is orthogonal to the exhaust flow direction of the first front pipe 32 and the minimum value A3min of the cross-sectional area that is orthogonal to the exhaust flow direction of the third front pipe 34 (A2>A1min, and A2>A3min); and as shown in FIG. 8, the vehicle width direction size W2 of the cross-sectional shape of the second front pipe 33 is smaller than the vertical direction size H2 of the cross-sectional shape of the second front pipe 33 (W2<H2).

The exhaust structure (not shown) of the comparison example is common to the exhaust structure 29 of the embodiment in that an exhaust pipe is connected to the exhaust port 13*ex*, is curved, passes the right side of the cylinder 13, then passes above the crankcase 12, and extends rearward and upward. The exhaust structure of the comparison example differs from the exhaust structure 29 of the embodiment in that the cross-sectional area orthogonal to the flow direction of the exhaust pipe is uniform throughout the extension direction of the exhaust pipe and that the cross-sectional shape of the exhaust pipe is uniform throughout the extension direction of the exhaust pipe.

As shown in FIG. 10, it was confirmed that the exhaust structure (graphs R1 and R2) of the embodiment has greatly improved output characteristics of the throttle opening degree of 37.5% and the throttle opening degree of 50% near the engine rotation speed of 10000 [r/min] compared to the exhaust structure (graphs S1 and S2) of the comparison example. Accordingly, it was found that according to the exhaust structure of the embodiment, it is possible to improve the output of the engine.

<Action and Effect>

As described above, the exhaust structure 29 of the motorcycle 1 of the embodiment described above includes: the exhaust pipe 30 that is connected to the exhaust port 13*ex* connecting to the combustion chamber 11*a* of the engine 11 and has a circular cross-sectional shape which is orthogonal to the exhaust flow direction; and the muffler 50 that is connected to the downstream side in the exhaust flow direction of the exhaust pipe 30, wherein the exhaust pipe 30 includes the second front pipe 33 that is connected to the muffler 50, the first front pipe 32 that is connected to the upstream side in the exhaust flow direction of the second front pipe 33, and the third front pipe 34 that is connected to the downstream side in the exhaust flow direction of the second front pipe 33, the cross-sectional area A2 that is orthogonal to the exhaust flow direction of the second front pipe 33 is larger than each of the minimum value A1min of the cross-sectional area that is orthogonal to the exhaust flow direction of the first front pipe 32 and the minimum value A3min of the cross-sectional area that is orthogonal to the exhaust flow direction of the third front pipe 34, and the vehicle width direction size W2 of the cross-sectional shape of the second front pipe 33 and the vertical direction size H2 of the cross-sectional shape of the second front pipe 33 are different from each other.

According to this configuration, by the cross-sectional area A2 that is orthogonal to the exhaust flow direction of the second front pipe 33 being larger than each of the minimum value A1min of the cross-sectional area that is orthogonal to the exhaust flow direction of the first front pipe 32 and the minimum value A3min of the cross-sectional area that is orthogonal to the exhaust flow direction of the third front pipe 34, since it is possible to adjust the pulsation of the exhaust gas in the exhaust pipe 30 and actively suction the combustion gas in the combustion chamber 11*a* of the engine 11, it is possible to improve the output of the engine 11. Additionally, the vehicle width direction size W2 of the cross-sectional shape of the second front pipe 33 and the vertical direction size H2 of the cross-sectional shape of the second front pipe 33 are different from each other, and thereby, it is possible to use an arrangement that prevents an increase in size of the vehicle or an arrangement that prevents the effect of interference on another configuration component. Accordingly, it is possible to suitably arrange the exhaust pipe 30 while improving the output of the engine 11.

In the embodiment described above, the engine 11 includes the crankcase 12 and the cylinder 13 that stands from the crankcase 12 and that has the exhaust port 13*ex*, the exhaust pipe 30 is connected to the exhaust port 13*ex*, is curved, passes the right side of the cylinder 13, then passes above the crankcase 12, and extends rearward and upward, and the vehicle width direction size W2 of the cross-sectional shape of the second front pipe 33 is smaller than the vertical direction size H2 of the cross-sectional shape of the second front pipe 33. Thereby, the following advantage is achieved.

Even in a case where the exhaust pipe 30 passes above the crankcase 12 and extends rearward and upward, since the second front pipe 33 does not occupy a space in the vehicle width direction, it is possible to prevent an increase in size in the vehicle width direction. Accordingly, it is possible to achieve the output improvement of the engine 11 and prevention of an increase in size in the vehicle width direction.

In the embodiment described above, the vehicle width direction size W2 of the cross-sectional shape of the second front pipe 33 is smaller than the maximum value W1max of the vehicle width direction size W1 of the cross-sectional shape of the first front pipe 32, and thereby, the following advantage is achieved.

It is possible to further prevent an increase in size in the vehicle width direction.

In the embodiment described above, the engine 11 is supported by the vehicle body frame 20, the vehicle body frame 20 includes the main frame 22 that extends rearward and downward from the head pipe 21 and the pivot plate 25 that extends downward from the rear end part of the main frame 22, and the second front pipe 33 passes the inside in the vehicle width direction of the pivot plate 25 and overlaps the pivot plate 25 when seen from the vehicle width direction. Thereby, the following advantage is achieved.

Since a foot part of a rider is generally located on the side of the pivot plate 25, the second front pipe 33 passes the inside in the vehicle width direction of the pivot plate 25, and thereby, it is possible to reduce a thermal impact on the foot part of the rider. Additionally, the second front pipe 33 overlaps the pivot plate 25 when seen from the vehicle width direction, and thereby, it is possible to further prevent an increase in size in the vehicle width direction.

In the embodiment described above, the swing arm 5 is swingably supported by the pivot plate 25, the swing arm 5 and the vehicle body frame 20 are connected by the rear cushion 6, and the second front pipe 33 is arranged between the pivot plate 25 and the rear cushion 6 in the vehicle width direction. Thereby, the following advantage is achieved.

It is possible to further prevent an increase in size in the vehicle width direction.

In the embodiment described above, the connection member 60 that connects the vehicle body frame 20 to the exhaust pipe 30 is provided, and the connection member 60 is welded to at least a surface of the second front pipe 33 having a larger one of the vehicle width direction size W2 of the cross-sectional shape and the vertical direction size H2 of the cross-sectional shape. Thereby, the following advantage is achieved.

Since a surface having a larger one of the vehicle width direction size W2 of the cross-sectional shape and the vertical direction size H2 of the cross-sectional shape in the second front pipe 33 has a larger curvature radius than a surface having a smaller one of the vehicle width direction size W2 of the cross-sectional shape and the vertical direction size H2 of the cross-sectional shape in the second front pipe 33, in comparison with a case where the connection member 60 is welded to the surface of the second front pipe 33 having a smaller one of the vehicle width direction size W2 of the cross-sectional shape and the vertical direction size H2 of the cross-sectional shape, welding work is facilitated.

MODIFIED EXAMPLE

The above embodiment is described using an example in which the exhaust pipe 30 is connected to the exhaust port 13*ex*, is curved, passes a right side of the cylinder 13, then passes above the crankcase 12, and extends rearward and upward; however, the embodiment is not limited thereto. For example, the exhaust pipe 30 may be connected to the exhaust port 13*ex*, be curved, pass below the crankcase 12, and then extend rearward and upward. For example, the configuration of the exhaust pipe 30 can be changed in accordance with a requirement specification.

The above embodiment is described using an example in which the exhaust pipe 30 includes the second front pipe 33 that is connected to the muffler 50, the first front pipe 32 that is connected to the upstream side in the exhaust flow direction of the second front pipe 33, and the third front pipe 34 that is connected to the downstream side in the exhaust flow direction of the second front pipe 33; however, the embodiment is not limited thereto. For example, the exhaust pipe may include a muffler connection part that is connected to the muffler 50, an exhaust pipe upstream part that is positioned on an upstream side in the exhaust flow direction of the muffler connection part, and an exhaust pipe downstream part that is positioned on a downstream side in the exhaust flow direction of the muffler connection part. That is, the exhaust pipe may not be a member in which the first front pipe 32, the second front pipe 33, and the third front pipe 34 are formed of a separate member and connected together and may be a member (an integrated object) in which the exhaust pipe upstream part, the muffler connection part, and the exhaust pipe downstream part are integrally formed of the same member. For example, the configuration of the exhaust pipe upstream part, the muffler connection part, and the exhaust pipe downstream part can be changed in accordance with a requirement specification.

The above embodiment is described using an example in which the vehicle width direction size W2 of the cross-sectional shape of the second front pipe 33 is smaller than the vertical direction size H2 of the cross-sectional shape of the second front pipe 33; however, the embodiment is not limited thereto. For example, the vehicle width direction size W2 of the cross-sectional shape of the second front pipe 33 may be larger than the vertical direction size H2 of the cross-sectional shape of the second front pipe 33. For example, the vehicle width direction size W2 of the cross-sectional shape of the second front pipe 33 and the vertical direction size H2 of the cross-sectional shape of the second front pipe 33 may be different from each other.

The above embodiment is described using an example in which the vehicle width direction size W2 of the cross-sectional shape of the second front pipe 33 is less than the maximum value W1max of the vehicle width direction size W1 of the cross-sectional shape of the first front pipe 32; however, the embodiment is not limited thereto. For example, the vehicle width direction size W2 of the cross-sectional shape of the second front pipe 33 may be a size equal to or more than the maximum value W1max of the vehicle width direction size W1 of the cross-sectional shape of the first front pipe 32. For example, the size relationship between the vehicle width direction size W2 of the cross-sectional shape of the second front pipe 33 and the vehicle width direction size W1 of the cross-sectional shape of the first front pipe 32 can be changed in accordance with a requirement specification.

The above embodiment is described using an example in which the second front pipe 33 passes the inside in the vehicle width direction of the pivot plate 25 and overlaps the pivot plate 25 when seen from the vehicle width direction; however, the embodiment is not limited thereto. For example, the second front pipe 33 may pass the outside in the vehicle width direction of the pivot plate 25. For example, the second front pipe 33 may be provided at a position that does not overlap the pivot plate 25 when seen from the vehicle width direction.

The above embodiment is described using an example in which the second front pipe 33 is arranged between the pivot plate 25 and the rear cushion 6 in the vehicle width direction; however, the embodiment is not limited thereto. For example, the second front pipe 33 may be arranged in a region other than the space between the pivot plate 25 and the rear cushion 6 in the vehicle width direction. For example, the arrangement configuration of the second front pipe 33 can be changed in accordance with a requirement specification.

The above embodiment is described using an example in which the connection member 60 that connects the vehicle body frame 20 to the exhaust pipe 30 is provided, and the connection member 60 is welded to the right side surface (a surface having a larger one of the vehicle width direction size W2 of the cross-sectional shape and the vertical direction size H2 of the cross-sectional shape) of the second front pipe 33; however, the embodiment is not limited thereto. For example, the connection member 60 may be welded to the left side surface (an inside surface in the vehicle width direction) of the second front pipe 33. For example, the connection member 60 may be welded to an upper surface or a lower surface (a surface having a smaller one of the vehicle width direction size W2 of the cross-sectional shape and the vertical direction size H2 of the cross-sectional shape) of the second front pipe 33. For example, the connection member 60 may be joined to the second front pipe 33 by means other than welding. For example, the joint configuration of the connection member 60 with the second front pipe 33 can be changed in accordance with a requirement specification.

The above embodiment is described using an example in which the engine 11 is a single cylinder engine; however, the embodiment is not limited thereto. For example, the engine 11 may be a multi-cylinder engine. For example, the configuration of the engine 11 can be changed in accordance with a requirement specification.

The above embodiment is described using a motorcycle in which an engine is mounted on the vehicle body side as an example of a saddle-riding type vehicle; however, the embodiment is not limited thereto. For example, the saddle-riding type vehicle may be a unit-swing-type motorcycle. For example, the configuration of the saddle-riding type vehicle can be changed in accordance with a requirement specification.

The above embodiment is described using a configuration in which a transmission transmits the drive force of the engine 11 to the rear wheel 4; however, the embodiment is not limited thereto. For example, a configuration may be used in which the transmission transmits the drive force of the engine 11 to the front wheel 3. For example, the configuration in which the drive force of the engine 11 is transmitted to the drive wheel can be changed in accordance with a requirement specification.

The present invention is not limited to the embodiment described above. For example, the saddle-riding type vehicle includes all types of vehicles on which a driver rides by straddling a vehicle body and includes not only a motorcycle (including a motorized bicycle and a scooter-type vehicle) but also a vehicle having three wheels (including a vehicle having two front wheels and one rear wheel in addition to a vehicle having one front wheel and two rear wheels). Further, the present invention is applicable to not only a motorcycle but also a vehicle having four wheels such as an automobile.

The configurations in the embodiment described above are examples of the present invention, and various changes such as replacing the constituent elements of the embodiment with known constituent elements can be made without departing from the scope of the present invention.

What is claimed is:

1. A saddle-riding type vehicle exhaust structure, comprising:

an exhaust pipe that is connected to an exhaust port connecting to a combustion chamber of an engine and has a circular cross-sectional shape which is orthogonal to an exhaust flow direction; and a muffler that is connected to a downstream side in the exhaust flow direction of the exhaust pipe, wherein the exhaust pipe comprises a muffler connection part that is connected to the muffler, an exhaust pipe upstream part that is positioned on an upstream side in the exhaust flow direction of the muffler connection part, and an exhaust pipe downstream part that is positioned on a downstream side in the exhaust flow direction of the muffler connection part, a cross-sectional area that is orthogonal to the exhaust flow direction of the muffler connection part is larger than each of a minimum value of a cross-sectional area that is orthogonal to an exhaust flow direction of the exhaust pipe upstream part and a minimum value of a cross-sectional area that is orthogonal to an exhaust flow direction of the exhaust pipe downstream part, and a vehicle width direction size of the cross-sectional shape of the muffler connection part is smaller than a vertical direction size of the cross-sectional shape of the muffler connection part, wherein the engine comprises:

a crankcase, and a cylinder that stands from the crankcase and that has the exhaust port, the exhaust pipe is connected to the exhaust port, is curved, passes a side of the cylinder, then passes above the crankcase, and extends rearward and upward, wherein the engine is supported by a vehicle body frame comprising:

a main frame that extends rearward and downward from a head pipe and a pivot plate that extends downward from a read end part of the main frame, wherein the muffler connection part passes inside in a vehicle width direction of the pivot plate.

2. The saddle-riding type vehicle exhaust structure according to claim 1, wherein the muffler connection overlaps the pivot plate when seen from a vehicle width direction.

3. The saddle-riding type vehicle exhaust structure according to claim 2, wherein a swing arm is swingably supported by the pivot plate, the swing arm and the vehicle body frame are connected by a rear cushion, and the muffler connection part is arranged between the pivot plate and the rear cushion in the vehicle width direction.

4. The saddle-riding type vehicle exhaust structure according to claim 1, wherein the engine is supported by a vehicle body frame, a connection member that connects the vehicle body frame to the exhaust pipe is provided, and the connection member is welded to at least a surface of the muffler connection part having a larger one of the vehicle width direction size of the cross-sectional shape and the vertical direction size of the cross-sectional shape.

5. A saddle-riding type vehicle exhaust structure comprising:

an exhaust pipe that is connected to an exhaust port connecting to a combustion chamber of an engine and has a circular cross-sectional shape which is orthogonal to an exhaust flow direction; and a muffler that is connected to a downstream side in the exhaust flow direction of the exhaust pipe, wherein the exhaust pipe comprises a muffler connection part that is connected to the muffler, an exhaust pipe upstream part that is positioned on an upstream side in the exhaust flow direction of the muffler connection part, and an exhaust pipe downstream part that is positioned on a downstream side in the exhaust flow direction of the muffler connection part, a cross-sectional area that is orthogonal to the exhaust flow direction of the muffler connection part is larger than each of a minimum value of a cross-sectional area that is orthogonal to an exhaust flow direction of the exhaust pipe upstream part and a minimum value of a cross-sectional area that is orthogonal to an exhaust flow direction of the exhaust pipe downstream part, and a vehicle width direction size of the cross-sectional shape of the muffler connection part is smaller than a maximum value of the vehicle width direction size of the cross-sectional shape of the exhaust pipe upstream part.

* * * * *